US009453507B2

(12) United States Patent
Ghodsi-Kameneh et al.

(10) Patent No.: US 9,453,507 B2
(45) Date of Patent: Sep. 27, 2016

(54) METERING SYSTEM

(75) Inventors: Hassan Ghodsi-Kameneh, Offenburg (DE); Alexander Hahn, Eigeltingen-Heudorf (DE)

(73) Assignee: EBM-PAPST ST. GEORGEN GmbH & Co. KG, St. Georgen (DE)

( * ) Notice: Subject to any disclaimer, the term of this patent is extended or adjusted under 35 U.S.C. 154(b) by 150 days.

(21) Appl. No.: 13/984,531

(22) PCT Filed: Jan. 14, 2012

(86) PCT No.: PCT/EP2012/000147

§ 371 (c)(1),
(2), (4) Date: Aug. 9, 2013

(87) PCT Pub. No.: WO2012/126544

PCT Pub. Date: Sep. 27, 2012

(65) Prior Publication Data

US 2014/0017094 A1 Jan. 16, 2014

(30) Foreign Application Priority Data

Mar. 19, 2011 (DE) ..... 10 2011 015 110

(51) Int. Cl.
*F04C 14/04* (2006.01)
*F04C 15/00* (2006.01)
(Continued)

(52) U.S. Cl.
CPC ..... *F04C 14/04* (2013.01); *F01C 21/08* (2013.01); *F04B 13/00* (2013.01);
(Continued)

(58) Field of Classification Search
CPC ..... F04C 2/00; F04C 2/22; F04C 5/00; F04C 13/00; F04C 13/001; F04C 14/04; F04C 15/0065; F04C 15/06; F04C 15/0061; F04C 18/00; F04C 18/22; F04C 28/04; F04C 29/005; F04C 29/0057; F04C 2210/1083; F04C 2220/24; F04C 2240/30; F04C 2240/40; F04C 2240/50; F04C 2240/51; F04C 2240/56; F04C 2240/805
USPC ..... 417/360, 410.1, 410.3; 418/45, 67, 153, 418/156, 104, 125, 139
See application file for complete search history.

(56) References Cited

U.S. PATENT DOCUMENTS 249,285 A 11/1881 Allen ..... 417/477
2,544,628 A 3/1951 Copping ..... 418/45
(Continued)

FOREIGN PATENT DOCUMENTS

DE 102004-011123 A 3/2005
DE 102007-000538 A 5/2008
(Continued)

OTHER PUBLICATIONS

Wikipedia, "Peristaltic Pump," pp. 1-7, retrieved Aug. 8, 2013.
(Continued)

*Primary Examiner* — Devon Kramer
*Assistant Examiner* — Chirag Jariwala
(74) *Attorney, Agent, or Firm* — Milton Oliver

(57) ABSTRACT

A metering system for metering a liquid has an electric motor (32) for setting a desired feed rate, by modifying the rotation speed of the electric motor. It furthermore has an eccentric drive (52, 56), drivable by said electric motor (32), for a pump (53) that has two delivery directions. It also has a pump ring (62) made of an elastomeric material and a stationary ring (70) which is arranged relative to the pump ring (62) and to the eccentric drive (52, 56) in such a way that a pump chamber (120), extending in a circumferential direction, is formed between the stationary ring (70) and pump ring (62). The chamber changes shape upon rotation of the electric motor (32) in order to deliver a liquid to be metered through the pump chamber (120). A stationary seal (142) is provided in the pump chamber (120), between two fluid ports.

12 Claims, 11 Drawing Sheets

(51) Int. Cl.

| | |
|---|---|
| ***F04C 13/00*** | (2006.01) |
| ***F04C 15/06*** | (2006.01) |
| ***F01C 21/08*** | (2006.01) |
| ***F04B 13/00*** | (2006.01) |
| ***F04B 43/00*** | (2006.01) |
| ***F04B 43/04*** | (2006.01) |
| ***F04B 43/14*** | (2006.01) |
| ***F04C 14/08*** | (2006.01) |
| ***F04C 5/00*** | (2006.01) |

(52) U.S. Cl.

CPC ..... *F04B 43/0063* (2013.01); *F04B 43/04* (2013.01); *F04B 43/14* (2013.01); *F04C 5/00* (2013.01); *F04C 13/001* (2013.01); *F04C 14/08* (2013.01); *F04C 15/0003* (2013.01); *F04C 15/0065* (2013.01); *F04C 15/06* (2013.01); *F04C 2210/1083* (2013.01); *F04C 2220/24* (2013.01); *F04C 2240/50* (2013.01); *F04C 2240/60* (2013.01)

(56) References Cited

U.S. PATENT DOCUMENTS

| | | | | |
|---|---|---|---|---|
| 3,408,947 | A * | 11/1968 | McMillan | 418/45 |
| 4,332,534 | A * | 6/1982 | Becker | 418/45 |
| 5,988,998 | A | 11/1999 | Glover | 418/45 |
| 6,019,582 | A | 2/2000 | Green | 417/477.8 |
| 7,068,191 | B2 | 6/2006 | Kuner et al. | 341/30 |
| 8,403,656 | B2 | 3/2013 | Fromm | 418/216 |
| 2007/0020123 | A1 | 1/2007 | Meyer et al. | 417/413.1 |
| 2008/0063542 | A1* | 3/2008 | Oguma | 417/354 |
| 2012/0027622 | A1 | 2/2012 | Ashburn | 417/53 |

FOREIGN PATENT DOCUMENTS

| | | | |
|---|---|---|---|
| DE | 202009016915 | U | 4/2010 |
| EP | 2194270 | B | 6/2013 |

OTHER PUBLICATIONS

Wikipedia, "Watson-Marlow Pumps," pp. 1-4, retrieved Aug. 14, 2013.

* cited by examiner

METERING SYSTEM

FIELD OF THE INVENTION

The invention relates to a metering system for metering a liquid.

BACKGROUND

Toxic exhaust gases and nitrogen oxides (NOx) occur in the context of the combustion process in diesel engines. To eliminate or break down these nitrogen oxides, it is known to inject a urea solution, by means of a metering pump, into the previously purified exhaust gas stream. The ammonia that is thereby released converts up to 80% of the nitrogen oxides into harmless nitrogen and water in a downstream SCR catalytic converter.

Because a urea solution is a chemically aggressive and very low-viscosity medium that has a tendency to crystallize, special pumps, in which the urea solution does not come into contact with the drive equipment of the metering pump, are used to deliver it. The delivery space is separated from the equipment space by, for example, a membrane or another flexible part.

The pump runs constantly during vehicle operation, establishing a pressure of, for example, 5 bar. Urea is present in the lines and systems. If the ambient temperature drops below the freezing point after the vehicle is shut off, the system would completely freeze up. Since not all components can withstand freezing, the urea solution must be pumped back into a reservoir container after the vehicle is shut off. In known systems, this occurs by means of a 4/2-way valve that reverses the delivery direction.

SUMMARY OF THE INVENTION

It is an object of the invention to make a novel metering system available.

According to the invention, this object is achieved by using a reversible variable-speed electric motor to drive the eccentric pump rotor, the rotor including an elastomeric ring, a portion of which forms a seal against the opposite wall of the pump chamber. It is thereby possible to make available a metering system that has a very compact construction and that, in the one rotation direction of the electric motor, draws the liquid to be metered out of the reservoir container and transports it to the consumption point, and, in the other rotation direction, draws that liquid out of the lines of the system and transports it back to the reservoir container.

The problems that have arisen in practice when a 4/2-way valve is used are thereby avoided, i.e. after the internal combustion engine is shut off, the rotation direction of the electric motor is reversed for a predetermined time period. Because said motor has no contact with the urea solution, reversal of the flow direction using the motor is robust, since such motors have a very long service life. The result is to prevent the urea solution from freezing in cold weather, since with such a motor it is very easy to pump the pump, lines, injection valves, etc. largely to an empty state when no urea solution is being injected, i.e. for example after the engine is shut off.

BRIEF FIGURE DESCRIPTION

Further details and advantageous refinements of the invention are evident from the exemplifying embodiment, in no way to be understood as a limitation of the invention, that is described below and depicted in the drawings.

FIG. 1 is a three-dimensional depiction of an embodiment of a metering system 30 that serves in this example to meter urea, the delivery direction being determined by the rotation direction of a multi-phase collectorless external-rotor motor 32 and the delivery rate per second being determined by the rotation speed of said electric motor 32, enabling very precise and economical adjustment of the desired metered amount;

FIGS. 10A to 10J are depictions to explain the mode of operation.

DETAILED DESCRIPTION

Figure 1:
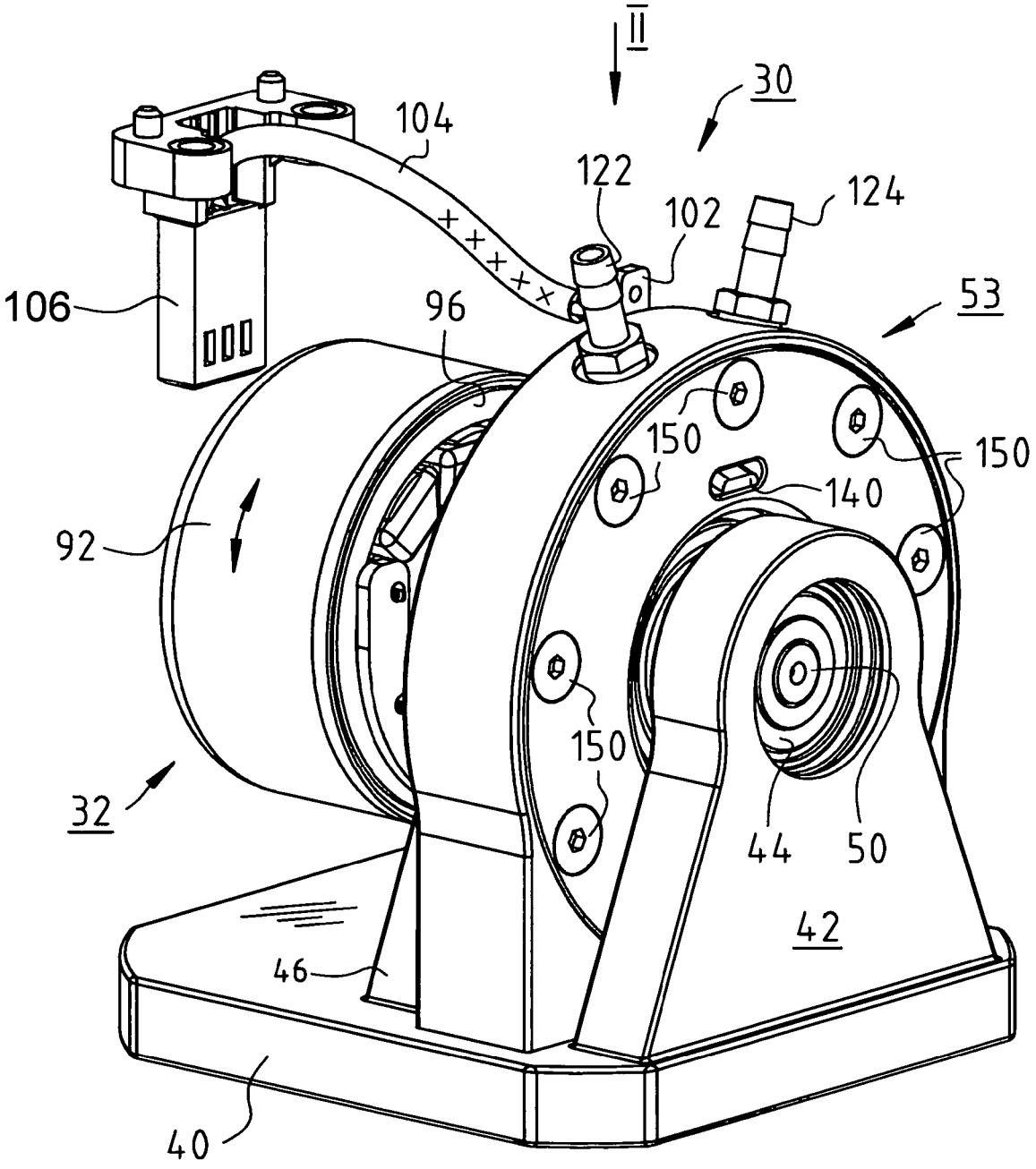
Figure 2:
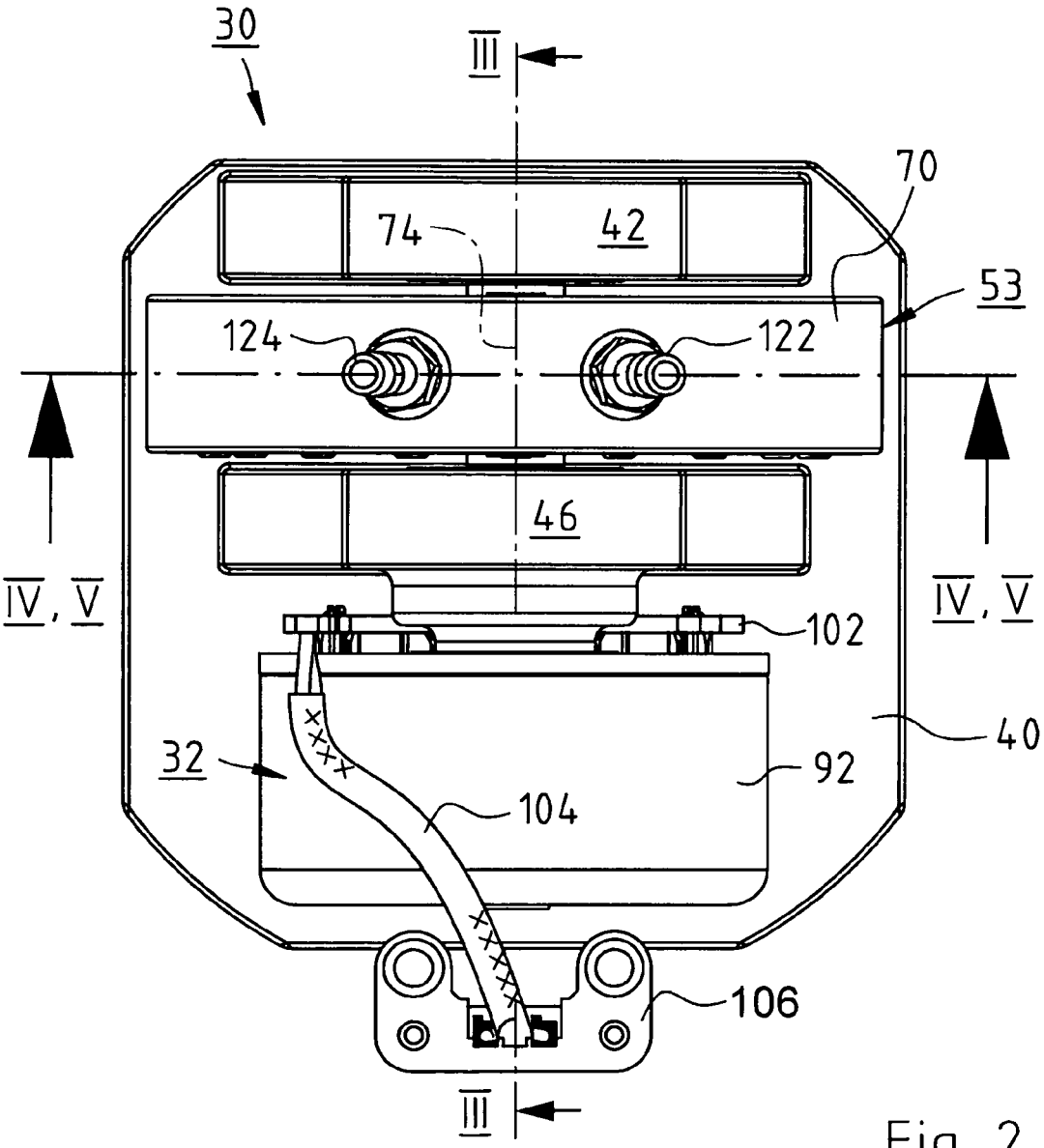
FIG. 2 is a plan view from above of the metering system of FIG. 1, viewed in the direction of arrow II of FIG. 1.

FIG. 1 is a three-dimensional depiction of a preferred embodiment of a metering system 30 as used, for example, to inject a urea solution as required into the exhaust gas stream of a diesel engine.

To drive it, the metering system has a multi-phase collectorless external-rotor motor 32 whose rotation speed behavior can be controlled by means of a PWM control signal, as is known e.g. from EP 1 413 045 B1 and corresponding U.S. Pat. No. 7,068,191, KUNER & SCHONDELMAIER. This makes it possible to control the rotation speed and rotation direction of the motor, in accordance with the rotation speed and power demand of the vehicle on which metering system 30 is located. The elements for this are defined by the manufacturer of the engine controller, depending on the requirements of the particular vehicle, and can differ greatly, depending on the type of vehicle (passenger car, truck, aircraft, helicopter, ship, etc.). An advantage of the present invention is that metering system 30 is suitable for very different applications.

Motor 32 has an electronic drive system, e.g. a three-phase inverter. This electronic system is in turn controlled by an arrangement that serves to decode the pulse duty factor pwm of a PWM signal that is delivered via a lead, and thereby to control the motor in terms of its rotation direction and rotation speed. If the pulse duty factor is referred to as "pwm," the following correspondences then result (as a non-binding example):

| pwm | Operating state |
|---|---|
| 0% to 5% | not permitted |
| 95% to 100% | not permitted |
| 5% to 85% | Metering mode. Rotation direction = pumping; n = 500 to 3500 rpm |
| 85% to 95% | Back-suction mode. Rotation direction = suction; n = 3500 rpm |

An example of a corresponding decoding circuit is described in detail in EP 1 413 045 B1 and U.S. Pat. No. 7,068,191, to whose content reference is made, in order to avoid excessive length. All known circuits can of course be used to modify the rotation speed of an electric motor.

FIG. 1 shows an example of a simple mechanical construction of a metering system 30 that is of course suitable for a wide variety of applications, e.g. including in the pharmaceutical industry and for the manufacture of foods, or e.g. in breweries, to name only a few examples.

System 30 here has a base 40 on which is arranged, on the right, a first support 42 which carries a bearing element 44 that is depicted here as a ball bearing.

Figure 3:
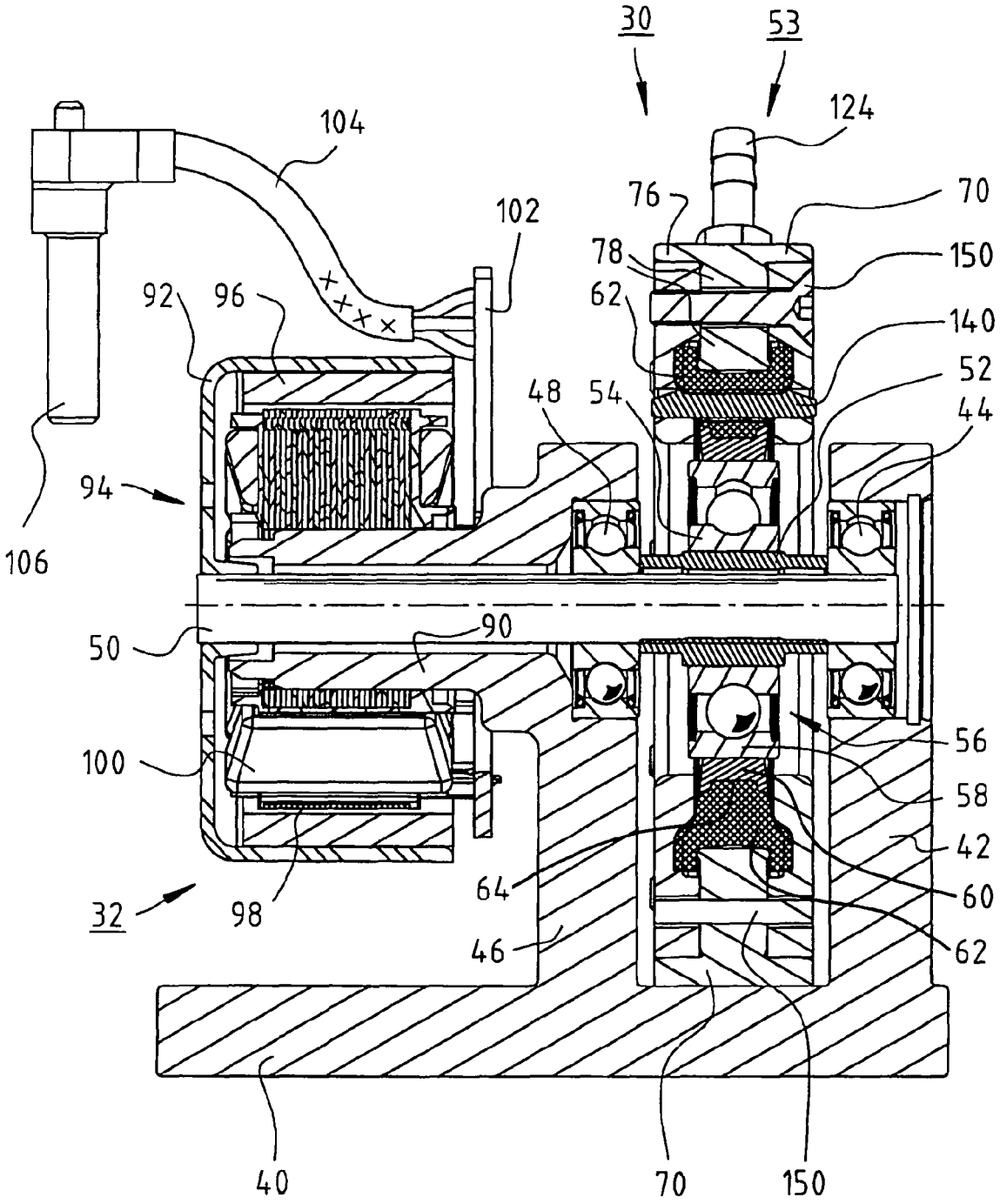
FIG. 3 is a longitudinal section through metering system 30, viewed along line III-III of FIG. 2.

Arranged at a distance from support 42 is a second support 46 that, according to FIG. 3, carries a bearing element 48 that is likewise depicted as a ball bearing.

As FIG. 3 shows, bearing elements 44, 48 are arranged so that they align with one another. Journaled in them is a shaft 50 on which is mounted, between bearing elements 44, 48, an eccentric bushing 52 that also serves as a spacer between bearing elements 44, 48. Bushing 52 serves to drive a pump 53 that is therefore arranged between bearing supports 42 and 46.

Mounted on eccentric bushing 52 is inner ring 54 of an eccentric bearing 56 whose outer ring 58 is mounted on the inner side of a ring 60 that serves as a support for a pump ring 62.

Pump ring 62 is manufactured from a suitable synthetic rubber (elastomer) and is mounted by plastic injection molding in an annular groove 64 of ring 60 so that it follows the motions of ring 60. The latter can be manufactured e.g. from steel, nickel, or bronze.

In experiments, a synthetic rubber referred to by the abbreviation PEDM (polyester-ethylene-diene monomer) has proved advantageous as an elastomer.

Figure 4:
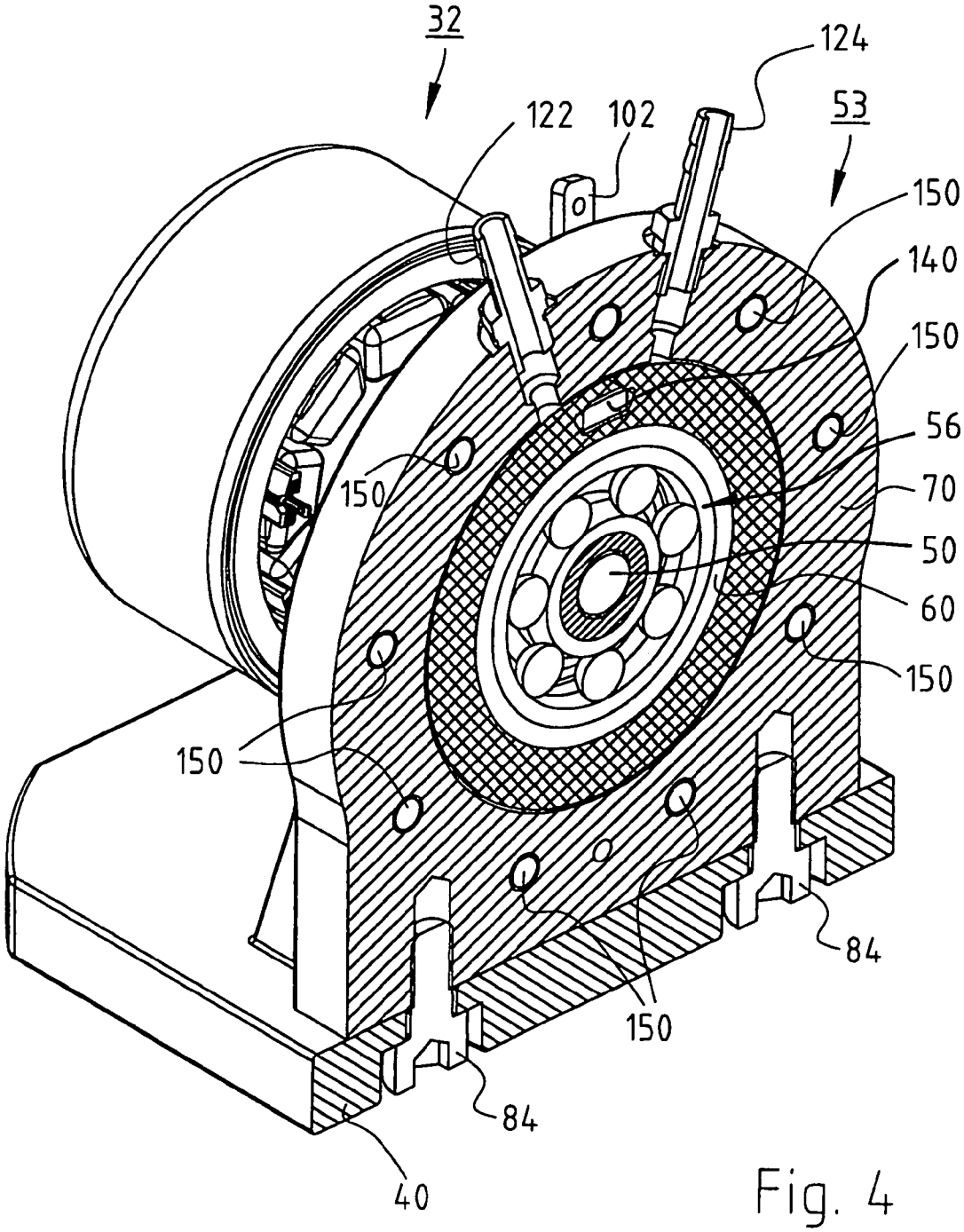
FIG. 4 is a plan view that shows the metering system of FIG. 3 from the right, viewed along line IV-IV of FIG. 2.
Figure 8:
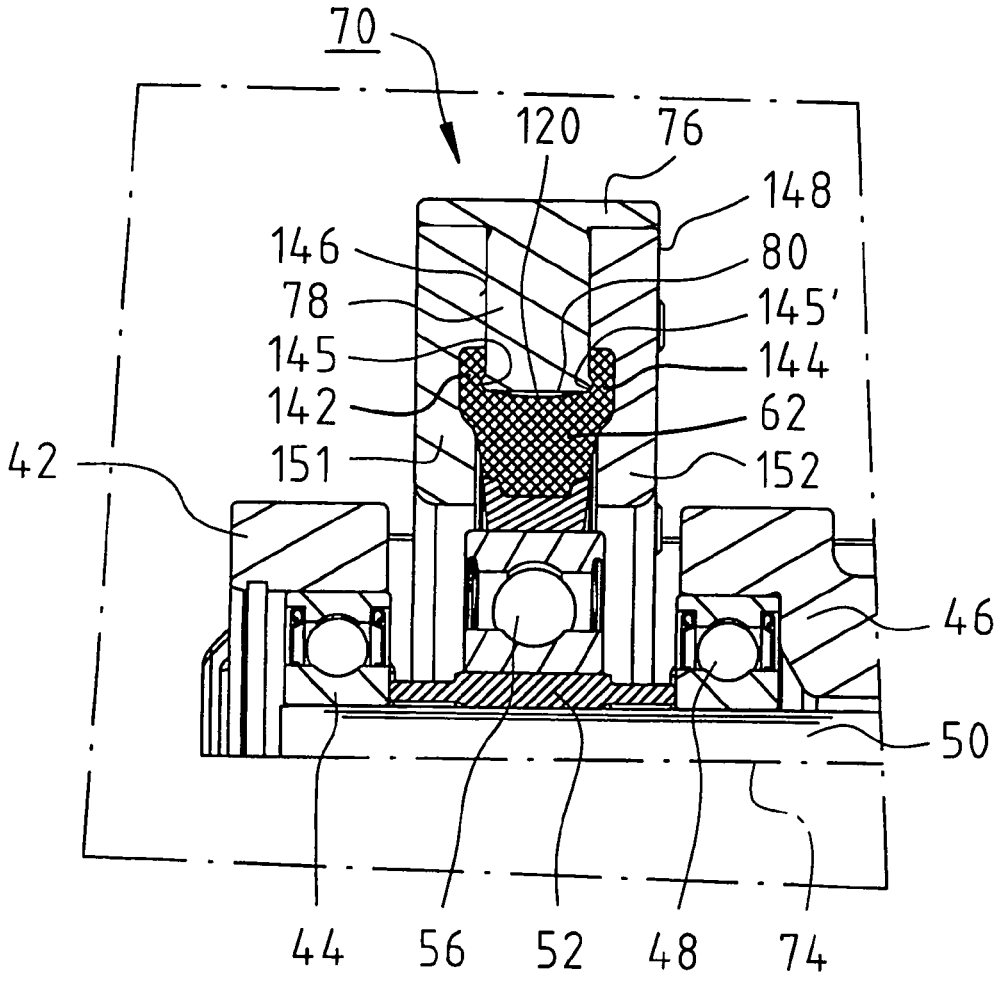
FIG. 8 is an enlarged section viewed along line VIII-VIII of FIG. 5; as with the sections according to FIGS. 6 and 7, this section applies to the rotor position of FIG. 5.
Figure 9:
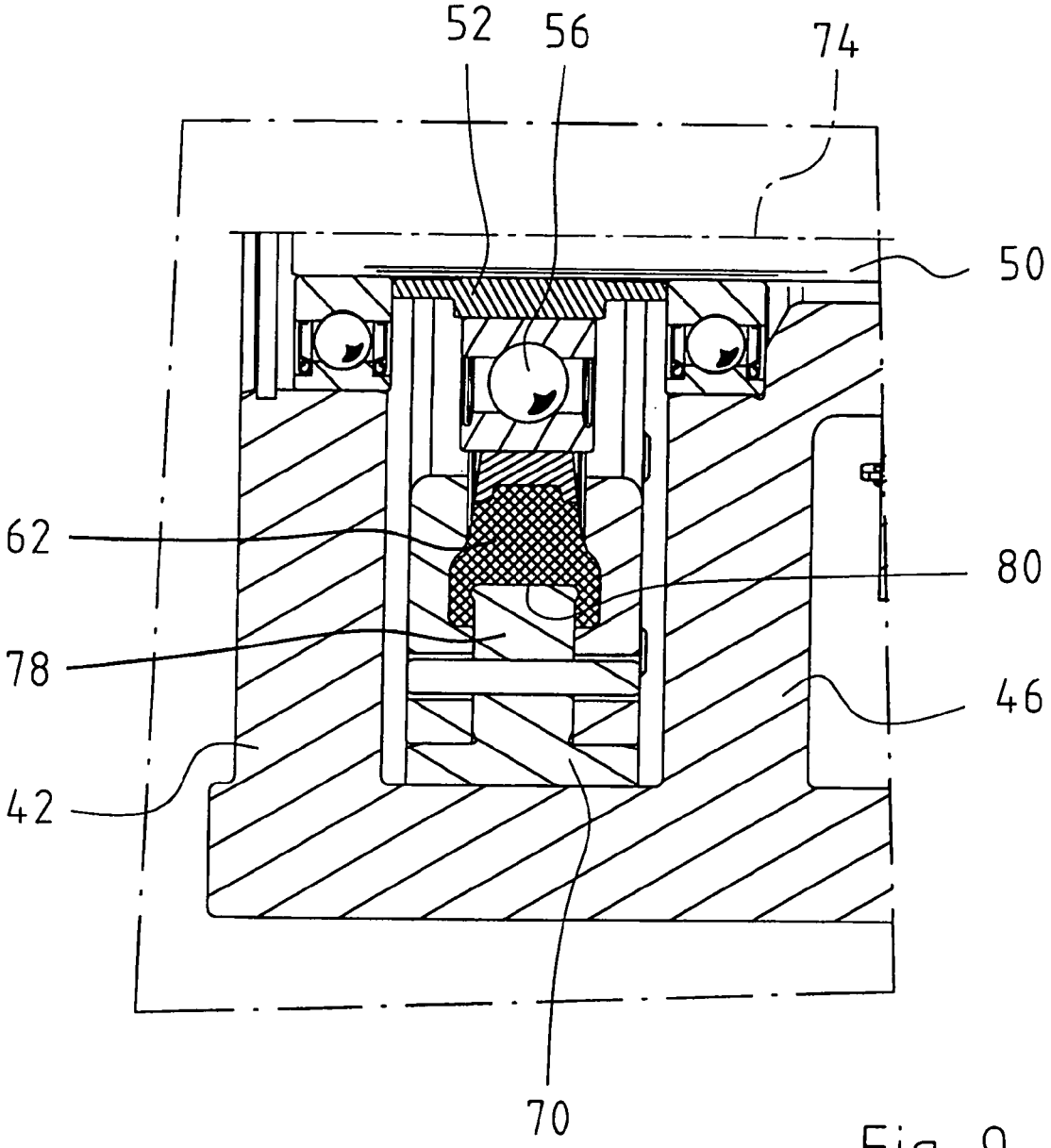
FIG. 9 is an enlarged section viewed along line IX-IX of FIG. 5; as with the sections according to FIGS. 6, 7, and 8, this section applies to the rotor position of FIG. 5.

As shown, for example, in FIGS. 8 and 9, pump ring 62 is surrounded on its outer side by a stationary ring 70 that, according to FIG. 4, is connected by means of bolts 84 to base 40 and has a T-shaped cross section, namely an edge portion 76 parallel to rotation axis 74 of the metering system, and a holding portion 78 that extends perpendicular to rotation axis 74 and whose radially inner edge is labeled 80.

Figure 5:
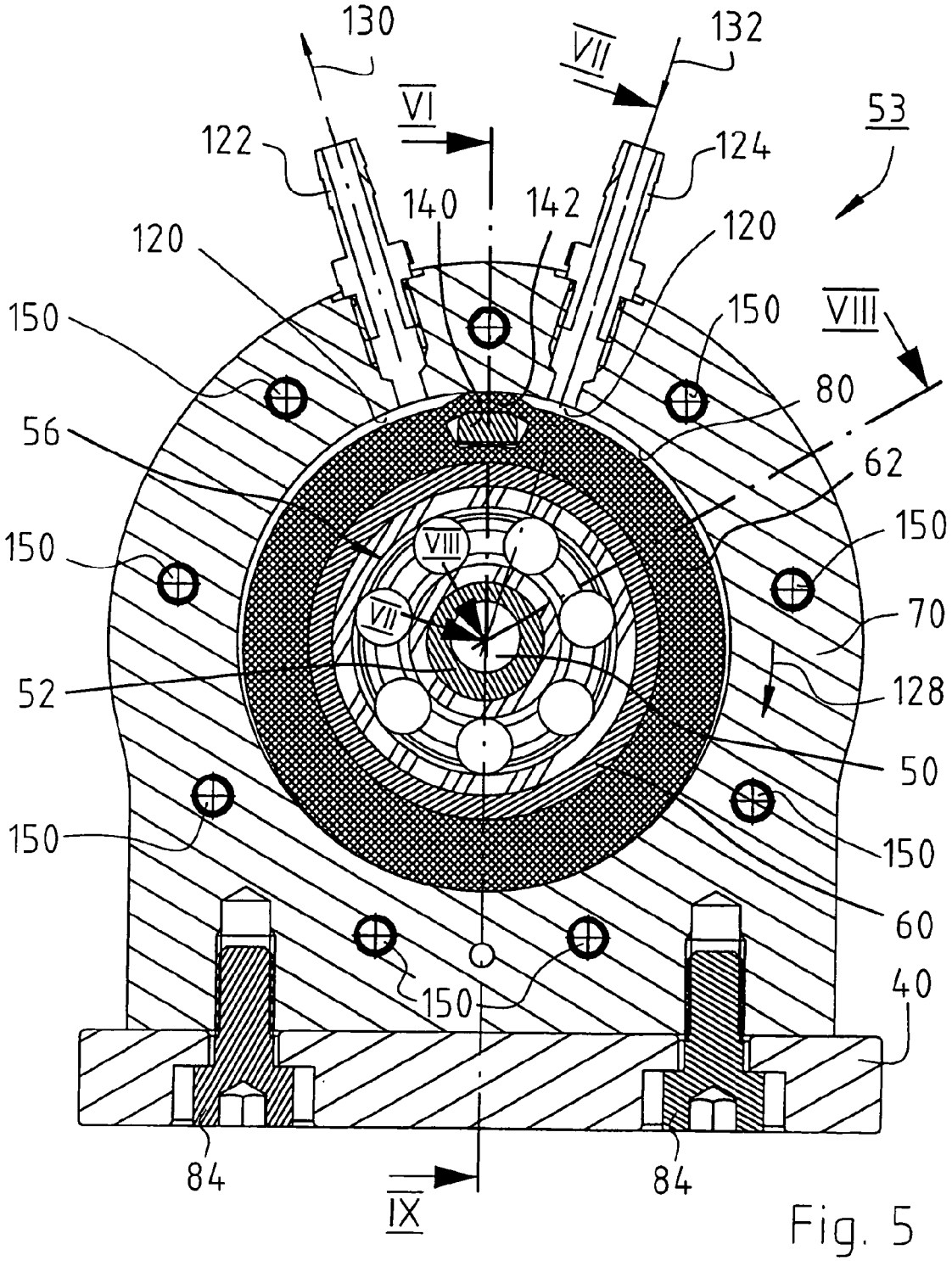
FIG. 5 is a plan view looking along line V-V of FIG. 2.

As FIGS. 4 and 5 show, stationary ring 70 is widened in its lower region and is connected to base part 40 by means of two bolts 84. Stationary ring 70 is thus located, in the installed state, between supports 42, 46, i.e. bearings 44, 48 are arranged closely against one another and can therefore serve as bearings for the entire metering system 30.

A support tube 90 through which shaft 50 extends (see FIG. 3) is provided on support 46. Shaft 50 is therefore journaled only by bearings 44 and 48. Mounted at its left end (in FIG. 3) is the cup-shaped magnetic yoke 92 of rotor 94 of motor 32. A ring magnet 96, which is separated by an air gap 98 from internal stator 100 of motor 32, is located on the inner side of yoke 92. Internal stator 100 is mounted on the outer side of support tube 90.

Motor 32 also has a circuit board 102 on which electronic components of motor 32 are located. Circuit board 102 is connected via a cable 104 to a plug connector 106. Motor 32 is supplied via cable 104 with energy, usually with DC voltage from a battery, and a control lead through which the rotation speed and rotation direction of motor 32 are controlled is also located in cable 104.

A great advantage of a collectorless motor, in particular in a vehicle, is the high efficiency that can be achieved with such an arrangement.

Motor 32 drives eccentric bushing 52 via shaft 50, and said bushing imparts an eccentric motion to eccentric bearing 54, so that said eccentric motion is likewise imparted to ring 60.

Figure 7:
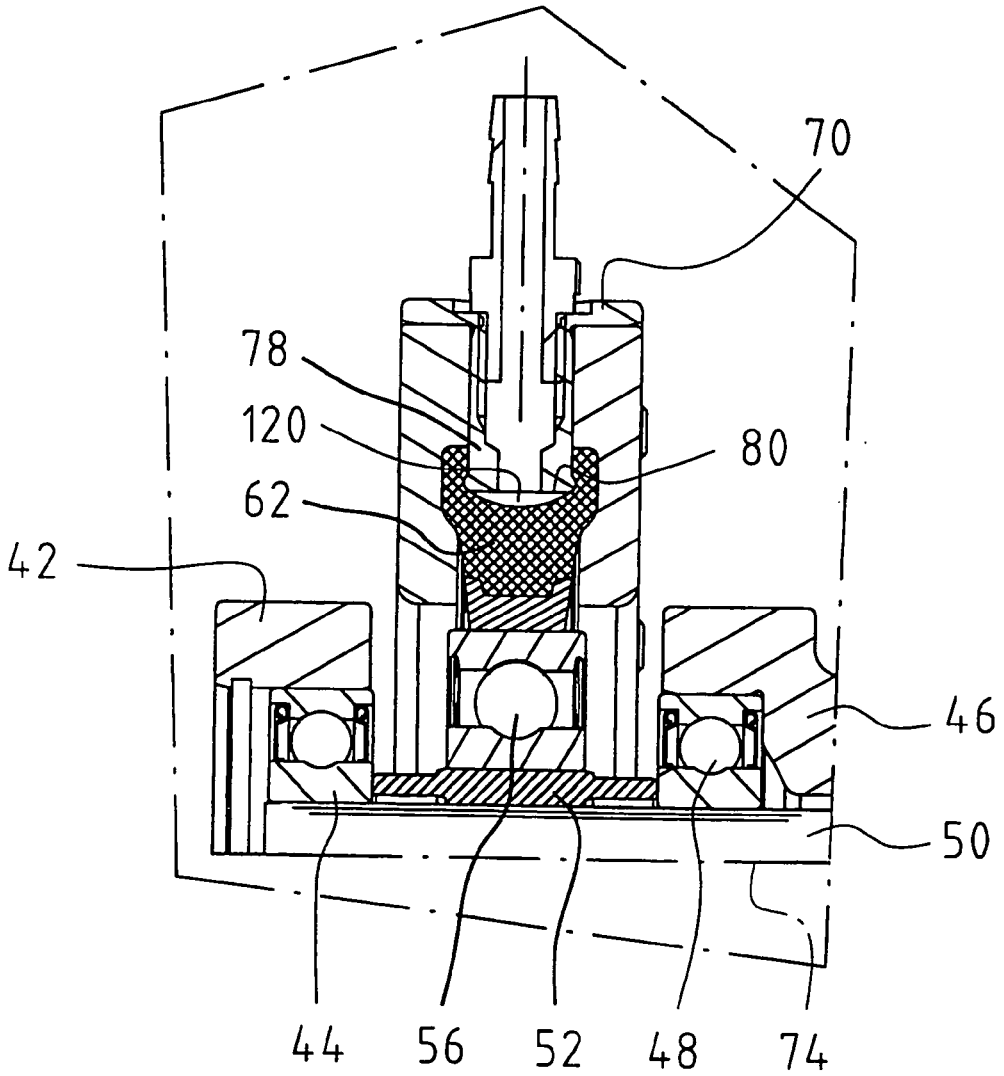
FIG. 7 is an enlarged section viewed along line VII-VII of FIG. 5; as with the section of FIG. 6, this section applies to the rotor position depicted in FIG. 5.

A pump chamber 120 is located between the radial outer side of pump ring 62 and the radial inner side 80 of holding portion 78 (see FIGS. 5 and 7).

Because pump ring 62 is in continuous rolling contact with its outer side 80 on the inner side of holding part 78, pump chamber 120 is constantly changing shape and thereby transports the metered fluid, that is present in pump chamber 120, from an inlet to an outlet.

To prevent this liquid from simply circulating in pump chamber 120, two connectors 122, 124, that are connected to the portions there of pump chamber 120, are provided at a suitable site (see FIG. 5).

When shaft 50 is rotating clockwise, as shown by arrow 128 of FIG. 5, the left part of pump chamber 120 thus becomes smaller, so that liquid is pushed out through connector 122 (see arrow 130 of FIG. 5), and the right part of pump chamber 120 becomes larger, so that liquid is drawn in through connector 124 (see arrow 132 of FIG. 5).

When shaft 50 is rotating oppositely to the direction of arrow 128, i.e. counterclockwise, the processes occur in the reverse direction, i.e. in this case, liquid is pushed out of connector 124 and liquid is drawn in through connector 122. The same pump 53 can thus be used to meter liquid and also to pump liquid out.

Figure 6:
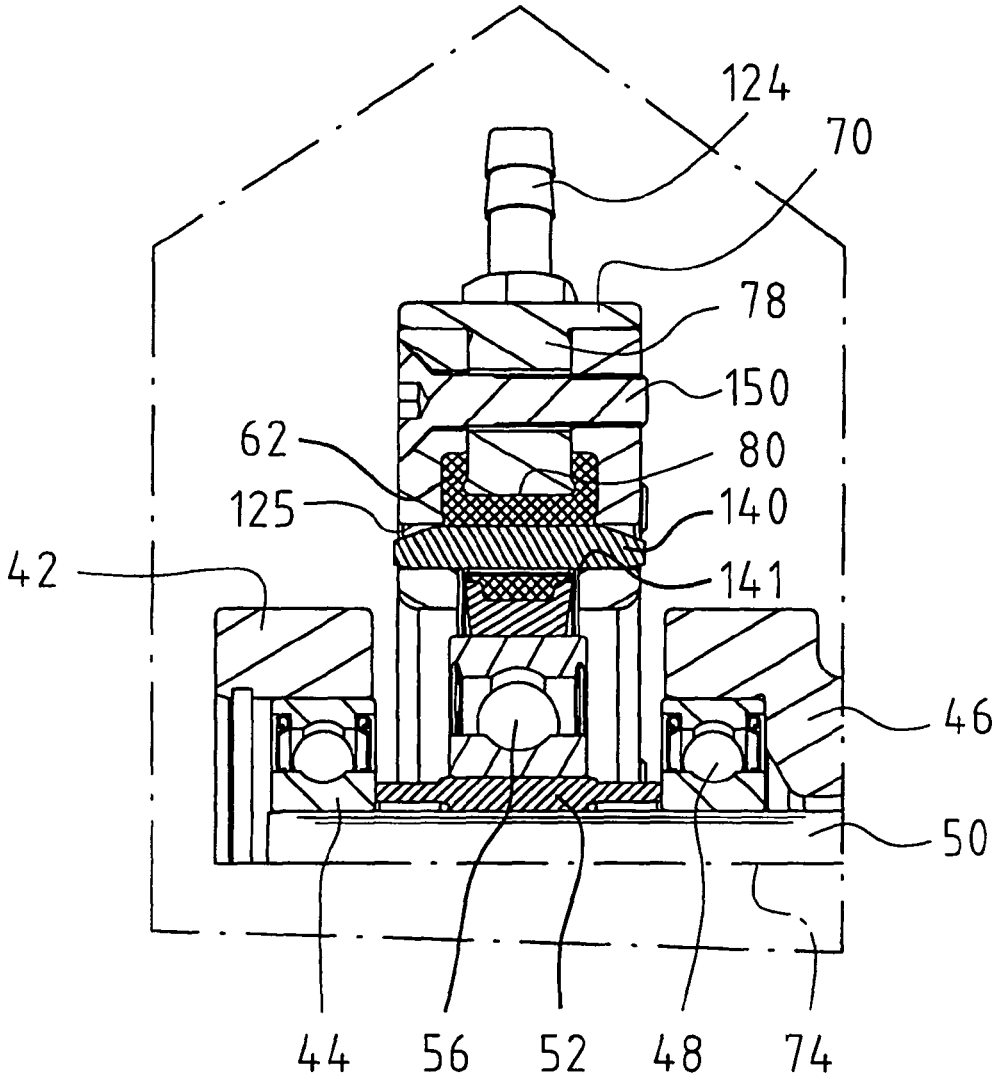
FIG. 6 is an enlarged section viewed along line VI-VI of FIG. 5; this section applies to the rotor position of FIG. 5 and looks different at other rotor positions.

FIGS. 1, 3, and 4 to 6 show that a wedge 140 is provided in an opening or transverse bore 141 of pump ring 62, said wedge having two functions:

a) It spreads or distends pump ring 62 in a radial direction so that it constantly abuts sealingly with its spread outer portion 142 against inner side 80 of stationary ring 70, thus preventing pumped fluid from flowing directly back to the suction side.

b) It "pegs" or prevents pump ring 62 from rotating relative to stationary ring 70, so that pump chamber 120 (between stationary ring 70 and pump ring 62) is sealed and no fluid can escape from it. FIGS. 1 & 6 shows how ends of wedge 140 are held in respective holes 125 in elements 151, 152.

As shown, for example, by FIG. 8, pump ring 62 has lateral extensions or flanges 142, 144 that extend along flanks 146, 148 of holding part 78 and are pressed by pressure plates (transverse stationary elements) 151, 152 against said flanks, so that pump chamber 120 is held (immobilized) and sealed against holding part 78 (see FIG. 8). At the transition from edge 80 to flanks 146, 148, holding portion 78 has a respective bead-like enlargement 145, 145' that further improves sealing there.

Pressure plates 151, 152 are pressed toward one another by bolts 150, one of which is depicted in FIG. 6. Pump chamber 120, which in an embodiment has a maximum height of less than a millimeter, is thus in communication with the outside world only through connectors 122, 124, and is otherwise hermetically sealed.

FIGS. 10A to 10J serve to explain the mode of operation. The reference characters are the same as in FIGS. 1 to 9, except that ring 60, on which pump ring 62 is mounted, is not depicted separately.

Figure 10A:
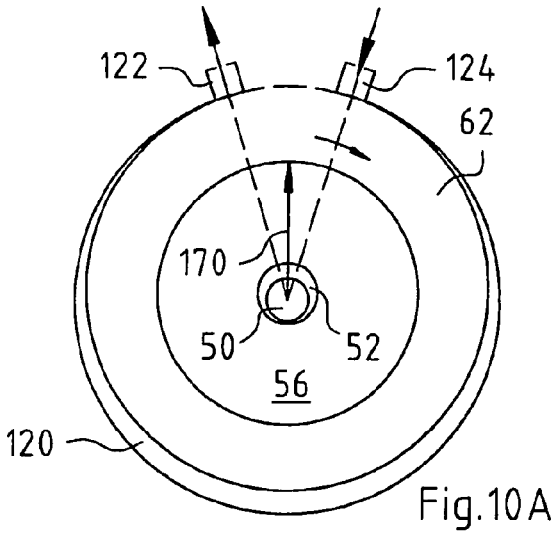
Figure 10B:
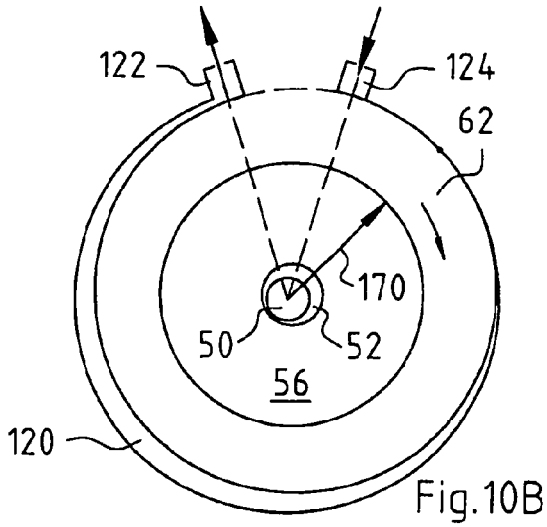
Figure 10C:
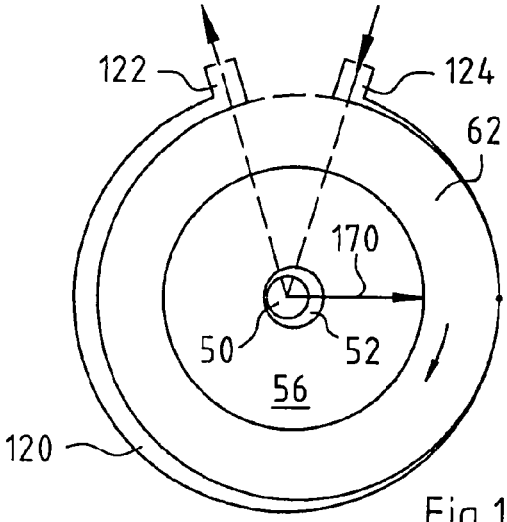
Figure 10D:
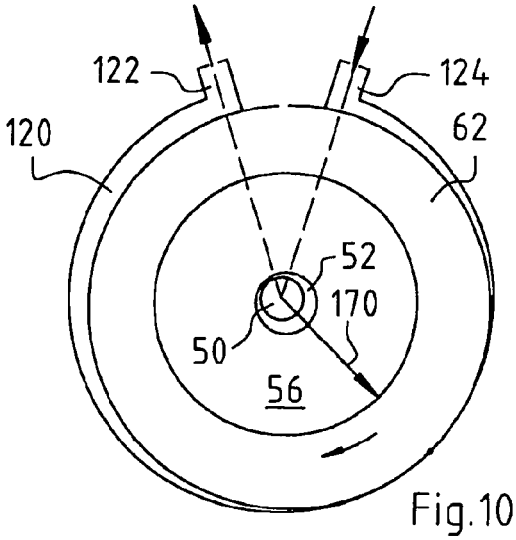
Figure 10E:
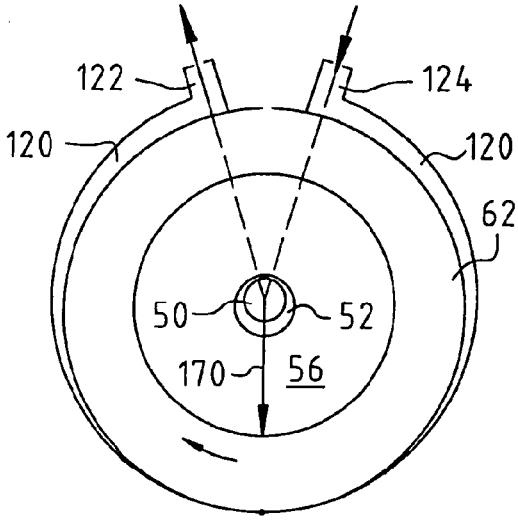
Figure 10F:
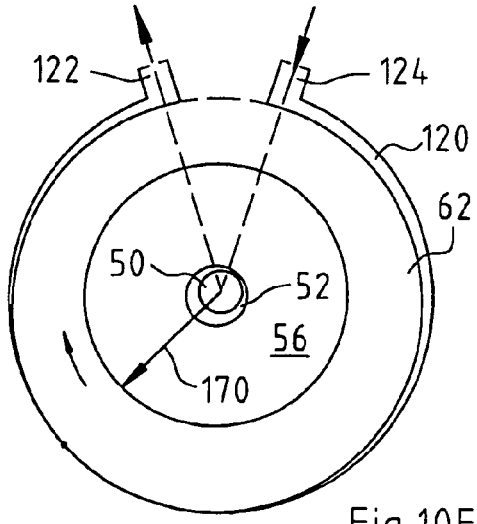
Figure 10G:
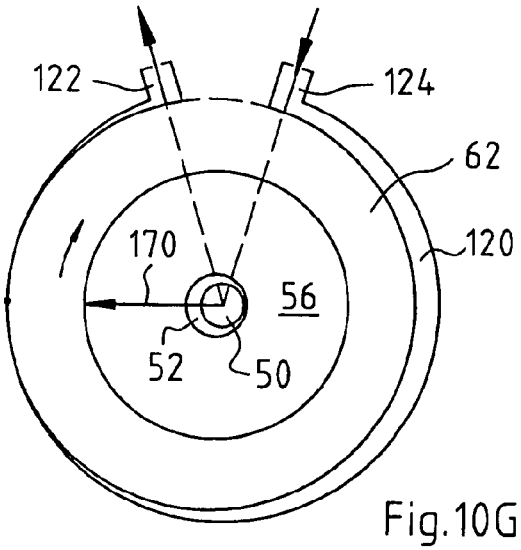
Figure 10H:
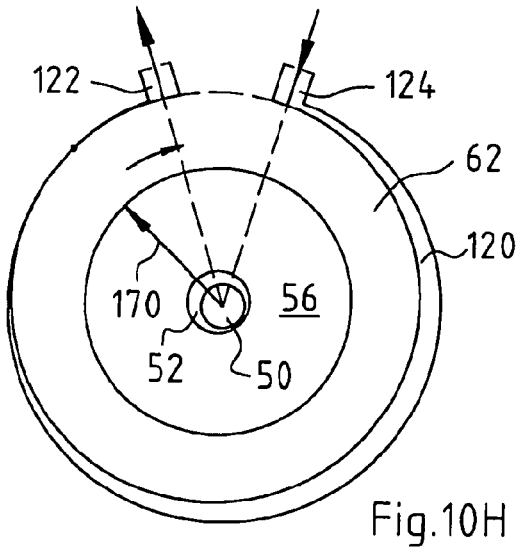
Figure 10I:
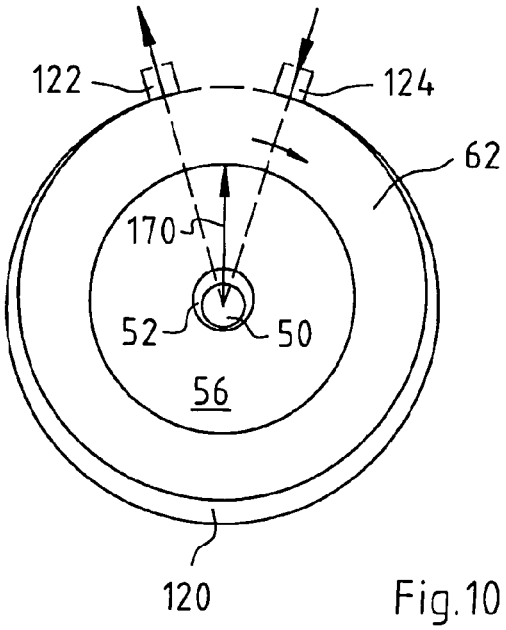

For illustration, a position pointer 170 is shown in each Figure, indicating the position of the maximum of eccentric bushing 52 in the context of a clockwise rotation, as follows:

FIG. 10A 12 o'clock
FIG. 10B 1:30
FIG. 10C 3:00
FIG. 10D 4:30
FIG. 10E 6:00
FIG. 10F 7:30
FIG. 10G 9:00
FIG. 10H 10:30
FIG. 10J 12:00

FIGS. 10A and 10J are consequently identical.

Eccentric bearing 56 thus causes pump ring 62 to be compressed, continuously in a circumferential direction and successively at the locations (for example) 12:00 (FIG. 10A), 1:30 (FIG. 10B), 3:00 (FIG. 10C), etc., sufficiently strongly that pump chamber 120 no longer allows passage there, and the fluid in pump chamber 120 is consequently transported forward (in a clockwise direction) and is pumped outward through connector 122. At the same time, new fluid is drawn in through connector 124.

In the context of a counterclockwise rotation, connector 122 becomes the suction connector and connector 124 becomes the discharge connector; this is not depicted, since it corresponds simply to a mirror image of FIGS. 10A to 10J.

Metering system 30 described above is very maintainable, since pump 53 can easily be replaced. Many variants and modifications are, of course, possible in the context of the present invention.

The invention claimed is:

1. A metering system for metering a liquid, comprising:

an electric motor (32) for establishing a desired liquid feeding rate by modifying a rotation speed of the electric motor;

an eccentric drive (52, 56), drivable by said electric motor (32), for a pump (53) that has two delivery directions;

a stationary ring (70);

a pump ring (62) made of an elastomeric material;

the pump ring (62) is located within said stationary ring and is nonrotatable relative to the stationary ring (70);

the stationary ring (70) being arranged, relative to the pump ring (62) and to the eccentric drive (52, 56), in such a way that a pump chamber (120) extending in a circumferential direction, viewed in a section extending perpendicular to the rotation axis (74) of the pump (53), is defined between the stationary ring (70) and pump ring (62), said chamber changing shape upon rotation of the electric motor (32) in order to deliver the liquid to be metered through the pump chamber (120), a stationary seal (142) being formed in said pump chamber (120) at an angular position between a suction connector (124; 122) and a discharge connector (122; 124);

a first transverse stationary element (151) and a second transverse stationary element (152) sandwich said pump ring (62) therebetween, said elements each being formed with a respective hole (125), and wherein the pump ring (62) is formed near its radially outer surface with a transverse internal bore (141) at a circumferential location angularly between the suction connector (124; 122) and the discharge connector (122; 124);

a wedge (140) is mounted through said holes (125) in said first and second transverse stationary elements (151, 152) and extends through said transverse internal bore (141), thereby pegging said pump ring (62) against possible rotation, said wedge also distending a transverse linear portion of said pump ring outer surface radially outward against the stationary ring (70), thereby producing said stationary seal (142) in the pump chamber (120).

2. The metering system according to claim 1, wherein the linear portion (142) of the pump ring (62) which is distended outward by the wedge (140) separates, viewed in a circumferential direction, a suction space on its one circumferential side from a discharge space on its other circumferential side.

3. The metering system according to claim 1, wherein the pump ring (62) is connected on its radial inner side by a plastic connection to a metal ring (60) that is in turn drivingly connected, to the eccentric drive (56).

4. The metering system according to claim 1, wherein the pump ring (62) is locally connected on its radial outer side to the stationary ring (70) forming, between the stationary ring (70) and pump ring (62), the pump chamber (120) extending in a circumferential direction.

5. The metering system according to claim 4, wherein the pump ring (62) is formed with shoulders (142, 144) that extend along flanks (146, 148) of the stationary ring (70), and wherein said first and second transverse stationary elements press the pump ring shoulders (142, 144) against said flanks of the stationary ring (70).

6. The metering system according to claim 1, wherein the eccentric drive drivable by the electric motor (32) comprises a bushing (52) having an outer periphery that is configured eccentrically with respect to a drive shaft (50) that is drivingly connected to said bushing (52).

7. The metering system according to claim 6, wherein there is arranged, on an outer periphery of the eccentric bushing (52), an inner ring of a rolling bearing (56) whose outer ring is connected to a metal ring (60) that, in turn, is connected by a plastic connection to the pump ring (62).

8. The metering system according to claim 1, further comprising two supports (42, 46), arranged at a distance from one another and having bearing elements (44, 48) that serve to journal a shaft (50);

a support tube (90) that extends in a direction away from the supports (42, 46) being provided on one of the supports (42, 46);

wherein the electric motor is a multi-phase electronically commutated external-rotor motor (32); an internal stator (100) of the electric motor (32) arranged on the support tube (90); and an external rotor (94) of the electric motor (32) connected to a free end of the shaft (50) and serves, during operation, to drive shaft (50), and that interacts with internal stator (100) during operation.

9. The metering system according to claim 8, in which the shaft (50) extends through the support tube (90).

10. The metering system according to claim 8, wherein the pump (53), for the liquid to be metered, is arranged between the two supports (42, 46), the shaft (50) being configured and connected to drive the eccentric drive (52, 56) of the pump (53).

11. The metering system according to claim 1, wherein the electric motor is an external-rotor motor, and wherein the direction of liquid flow through the pump (53) is specified by the rotation direction of the external-rotor motor (32).

12. The metering system according to claim 1, wherein the electric motor is so configured that a magnetically effective air gap (98) is defined between a stator (100) and a rotor (94) of the electric motor.

* * * * *